US008714388B2

(12) United States Patent
Miller et al.

(10) Patent No.: US 8,714,388 B2
(45) Date of Patent: May 6, 2014

(54) COLLAPSIBLE RECTANGULAR CONTAINER

(71) Applicant: Buckhorn, Inc., Milford, OH (US)

(72) Inventors: Daniel R. Miller, Cincinnati, OH (US); David T. Devaney, Arnold, MD (US)

(73) Assignee: Buchorn, Inc., Milford, OH (US)

( * ) Notice: Subject to any disclaimer, the term of this patent is extended or adjusted under 35 U.S.C. 154(b) by 0 days.

(21) Appl. No.: 13/684,279

(22) Filed: Nov. 23, 2012

(65) Prior Publication Data

US 2013/0146591 A1 Jun. 13, 2013

Related U.S. Application Data

(60) Provisional application No. 61/567,663, filed on Dec. 7, 2011.

(51) Int. Cl.
*B65D 21/02* (2006.01)
*B65D 21/036* (2006.01)
*B65D 6/26* (2006.01)

(52) U.S. Cl.
CPC ..... *B65D 7/30* (2013.01); *B65D 21/0223* (2013.01)
USPC ..... 220/4.29; 220/7; 220/6; 206/508

(58) Field of Classification Search
CPC ..... B65D 7/30; B65D 7/28; B65D 7/26; B65D 7/24; B65D 21/0223; B65D 21/0222; B65D 21/0217; B65D 21/0209
USPC ..... 220/4.29, 4.28, 6, 7, 4.16, 4.31, 4.32, 220/4.01; 206/509, 508, 507, 505, 503, 206/600, 386
See application file for complete search history.

(56) References Cited

U.S. PATENT DOCUMENTS

| | | | | |
|---|---|---|---|---|
| 2,936,090 | A | 5/1960 | Caldwell | |
| 3,570,698 | A | 3/1971 | Dougherty | |
| 6,131,757 | A | 10/2000 | Clark et al. | |
| 6,253,948 | B1 | 7/2001 | Ficker | |
| 7,083,061 | B2 * | 8/2006 | Spindel et al. | 220/6 |
| 2011/0062167 | A1 | 3/2011 | Colton et al. | |

* cited by examiner

*Primary Examiner* — Robert J Hicks
(74) *Attorney, Agent, or Firm* — Mattingly & Malur, PC

(57) ABSTRACT

A collapsible rectangular container includes a container body having a pair of opposed solid side walls, a pair of opposed foldable side walls hingedly connected to the pair of solid side walls and a base end wall and a top end wall removably and slidably connected to ends of the pairs of solid and foldable side walls when the container body is in an erected position. The base and top end walls are removable from the ends of the container body to permit the body to be collapsed into a flat configuration by folding the side walls inwardly when the base and top end walls are removed. The end walls are slidably received on one of the solid side walls when the container body is in a collapsed position. When the containers are collapsed and/or erected, the containers interlock for shipment.

11 Claims, 17 Drawing Sheets

COLLAPSIBLE RECTANGULAR CONTAINER

FIELD OF THE INVENTION

The invention relates to a collapsible rectangular container for containing a liquid or viscous material.

DESCRIPTION OF RELATED ART

Rectangular containers for liquid are known in which the liquid is contained in a bag or liner within the container. Wooden and metal barrels are also known for containing and storing liquid. Rectangular containers, however, have the advantage of utilizing space more efficiently than barrels, especially in the transportation of containers by truck and cargo vessels.

There is a need for an improved collapsible rectangular container which functions as a barrel in an erected position and stacks for return shipment in a collapsed position and which provides security against unauthorized entry or tampering.

SUMMARY OF THE INVENTION

It is an object of the present invention to provide a collapsible container of rectangular configuration for containing liquids and which enables the liquid contents to be stored and transported in a liquid or solid state and which also enables the storage or transportation of a viscous material.

Another object of the invention is to provide a collapsible container of rectangular configuration which interlocks with other similar containers in both an erected position and in a collapsed position.

Another object of the invention is to provide a collapsible container of rectangular configuration which has a tamper proof construction that prevents the insertion of pins or needle shaped objects into the interior of the container when in the erected position.

Still another object of the present invention is to provide a collapsible container of rectangular form constructed of plastic wherein the side walls and end walls may be reinforced with metal or other materials.

A further object of the invention is to provide a collapsible rectangular container having corrugations or ribs and recesses in the side walls and end walls which promote freezing and thawing of the contents while providing reinforcement of the walls.

The present invention achieves the above and other objects by providing a collapsible rectangular plastic container having a container body constructed of a pair of opposed solid side walls, a pair of opposed foldable side walls hingedly connected to the solid side walls and a base end wall and a top end wall removably and slidably connected to ends of the pairs of solid and foldable side walls when the container body is in an erected position. The base and top end walls are removable from the ends of the container body to permit the body to be collapsed into a flat configuration by folding the foldable side walls inwardly when the base and top end walls are removed. The base and top end walls are slidably received on one of the solid side walls, from each end, when the container body is in the collapsed position. The side walls and end walls may be provided with ribs and recesses whereby adjacent containers may interlock with each other in the erected position and ribs on one of the solid walls for engaging the base and end walls of an adjacent container when containers are stacked adjacently in the collapsed position, on a pallet for example. The side and end walls further may be reinforced with metal or other hard material inserts.

These, together with other objects and advantages which will be subsequently apparent, reside in the details of construction and operation as more fully described and claimed hereafter, reference being made to the accompanying drawings forming a part hereof, wherein like numerals refer to like parts throughout.

DETAILED DESCRIPTION OF THE PREFERRED EMBODIMENTS

Figure 1:
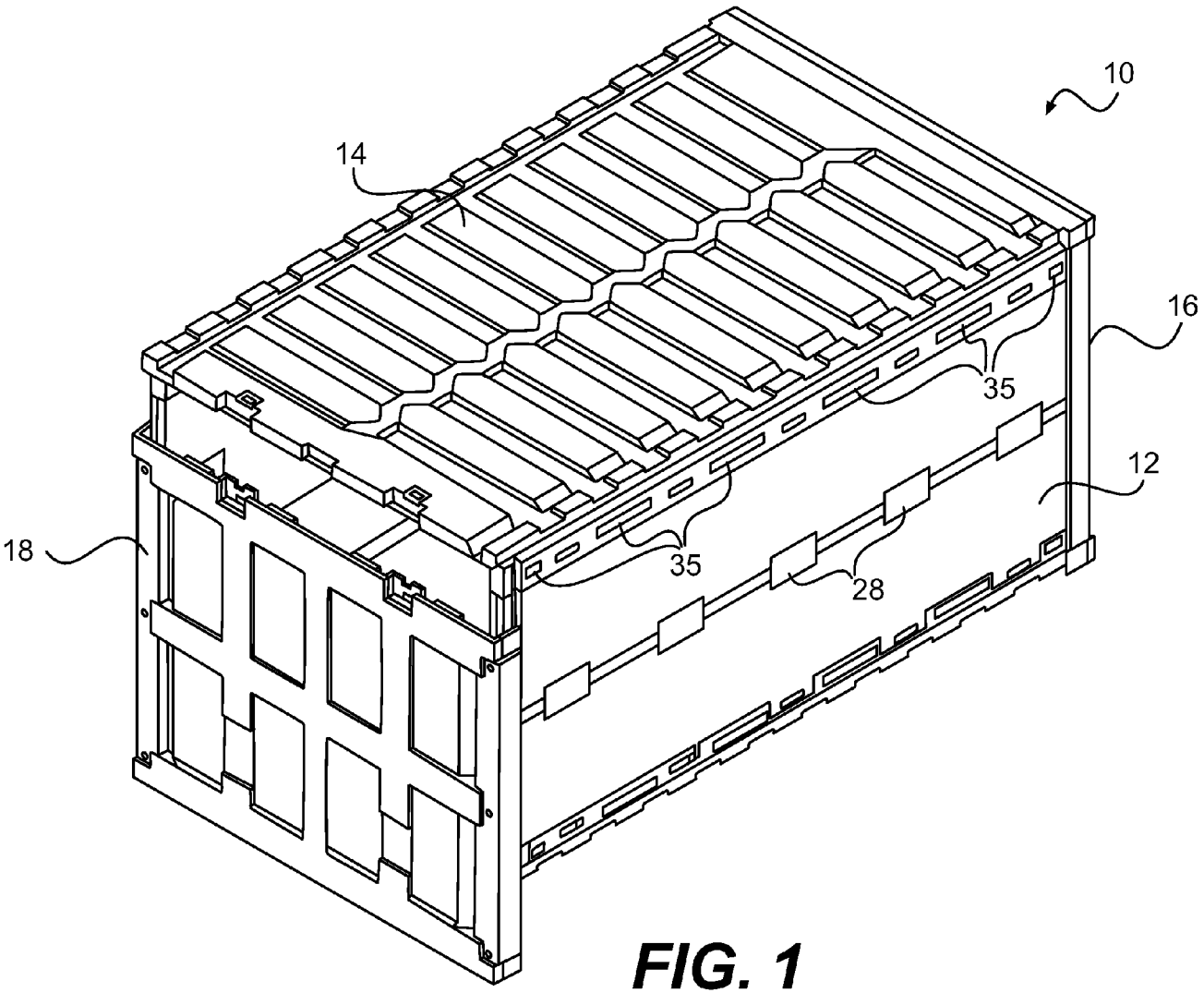
FIG. 1 is a perspective view of one embodiment of a collapsible rectangular container in a horizontal position according to the present invention showing the top end wall partially opened.
Figure 2:
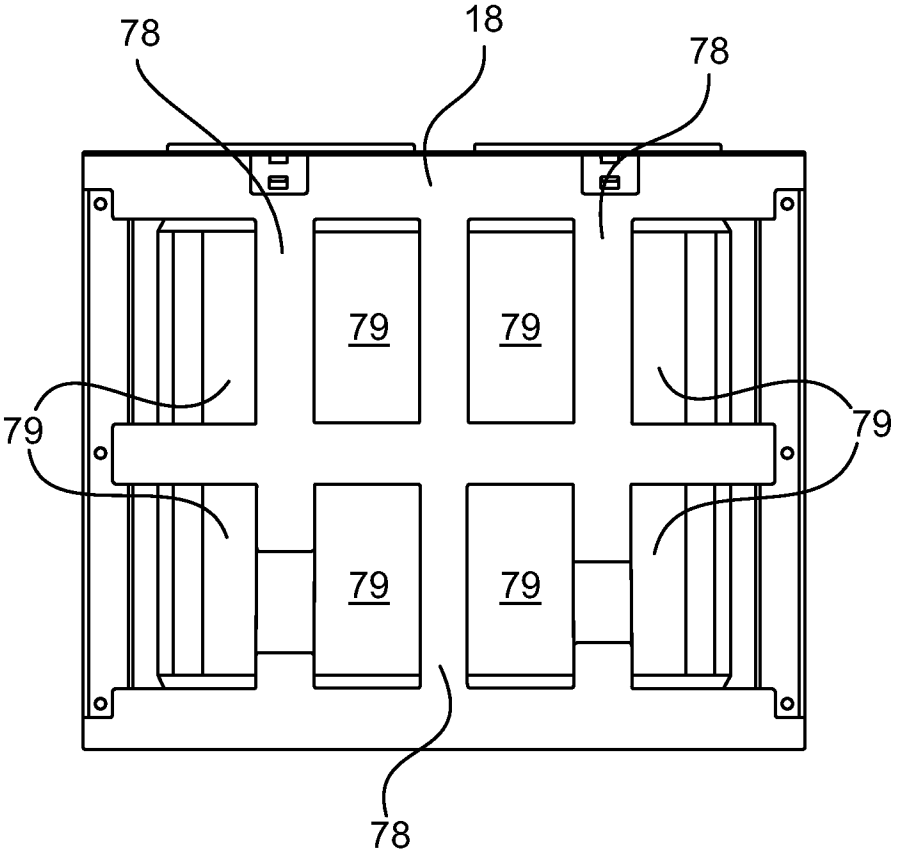
FIG. 2 is an elevational view of the top end wall of the container of FIG. 1 showing the end wall in a closed position.

Referring to the drawings, shown in FIG. 1 is a collapsible rectangular container, generally referred to by the numeral 10, having a container body constructed of a pair of opposed foldable side walls 12 hingedly connected to a pair of opposed solid side walls 14 and having a base end wall 16 and a top end wall 18. The base and top end walls 16, 18 are alternatively referred to as lids. The end walls 16 and 18 are slidably connected to the opposite ends of the container body so that both the base and top end walls are easily attached and removed.

Figure 21:
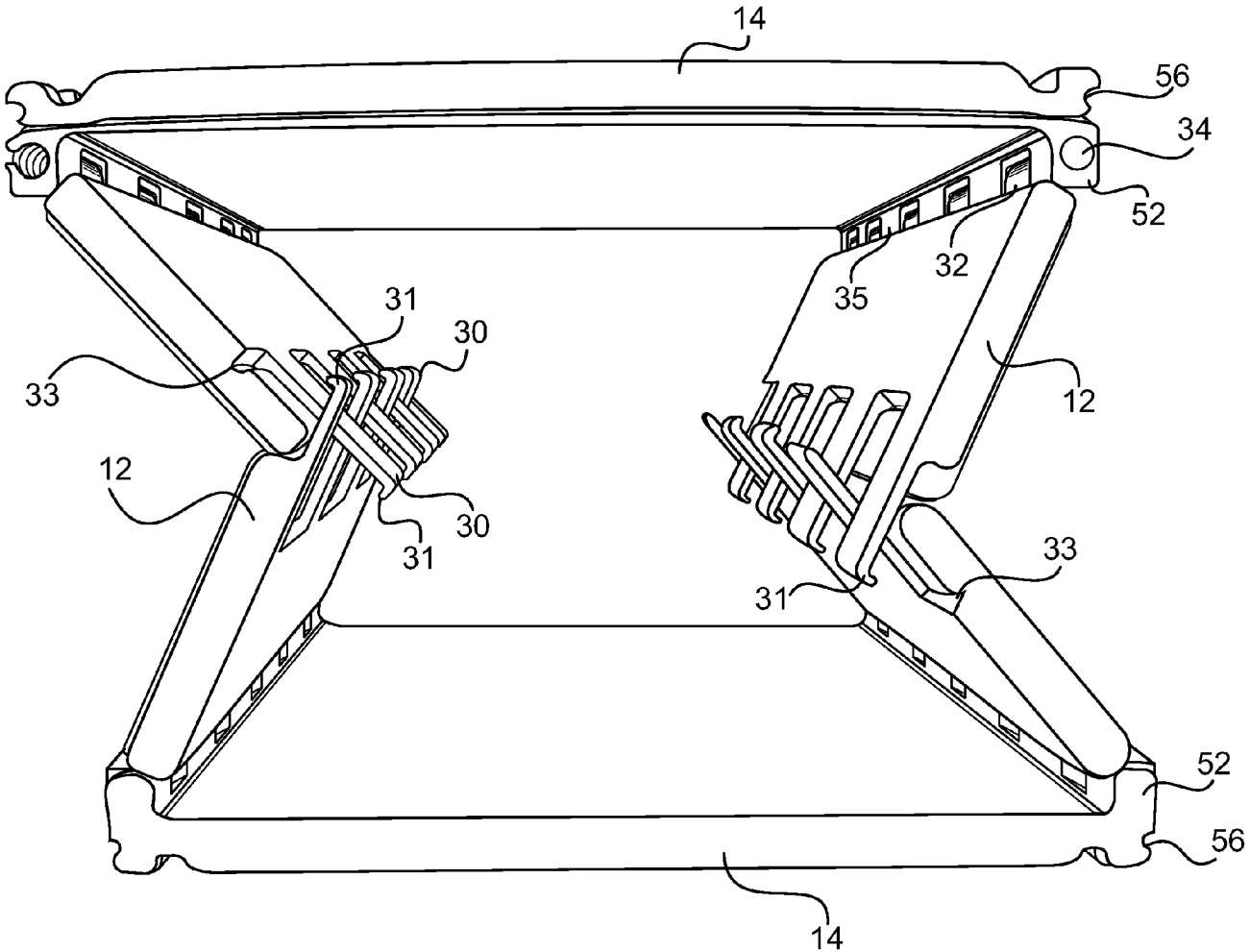
FIG. 21 is an end view showing the container in a partially collapsed position with the end walls removed.

The opposed foldable side walls 12 are identical in configuration and construction. The opposed solid side walls 14 are also identical with the exception of raised pads, to be discussed in detail hereinafter, that are provided on one of the solid walls 14 for interlocking of adjacent containers in the erected position and interlocking of adjacent stacked containers in the collapsed position, with the base and top end walls engaging the raised pads of the one solid wall of an adjacent stacked container in the collapsed position. Additionally, in the assembly of the container, one of the solid walls 14 is oriented to be 180 degrees out of matching position with respect to the opposite side wall 14, as best seen in FIG. 21. The base end wall 16 and the top end wall 18 are also identical in construction.

Figure 3:
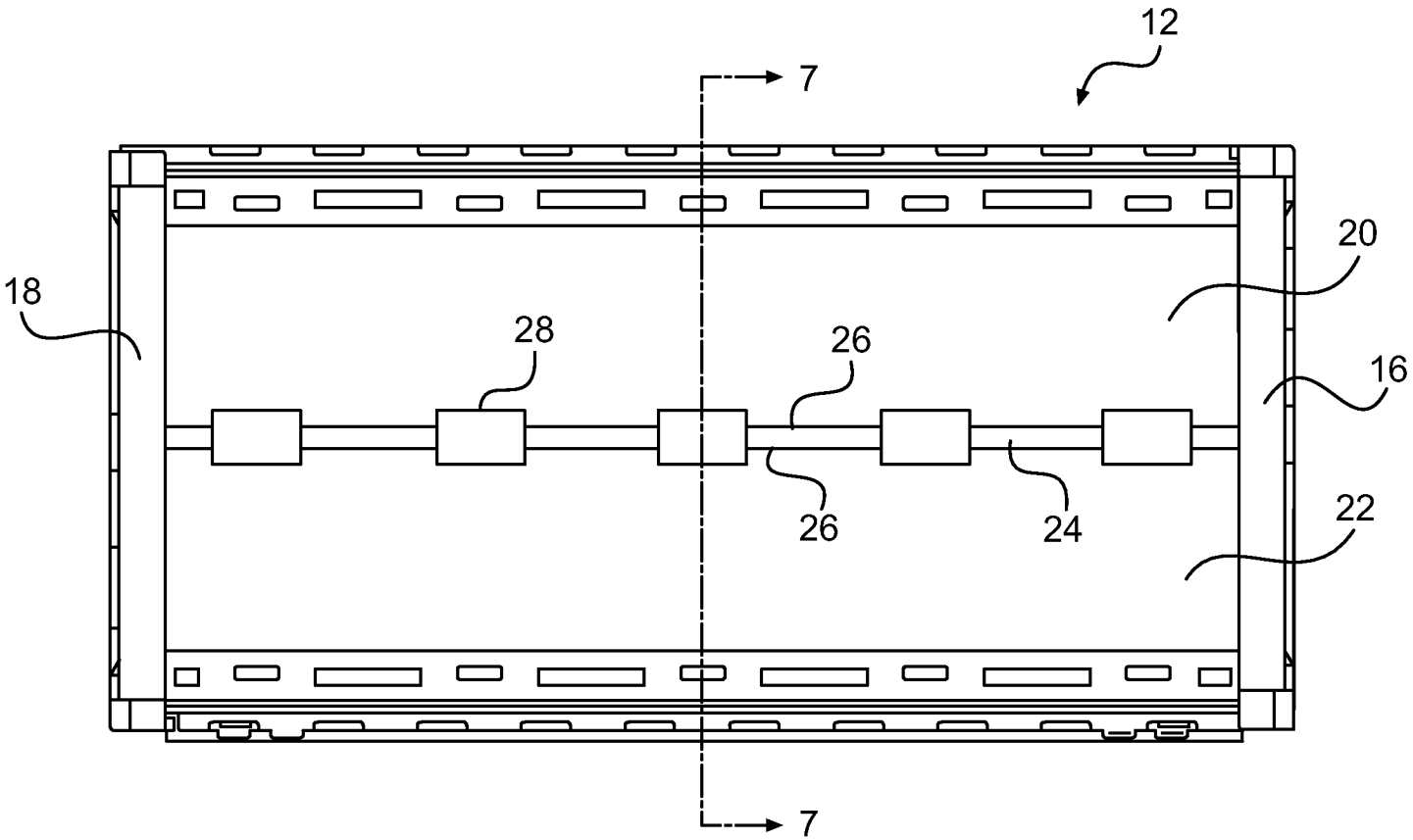
FIG. 3 is a side elevational view of the container of FIG. 1.
Figure 4:
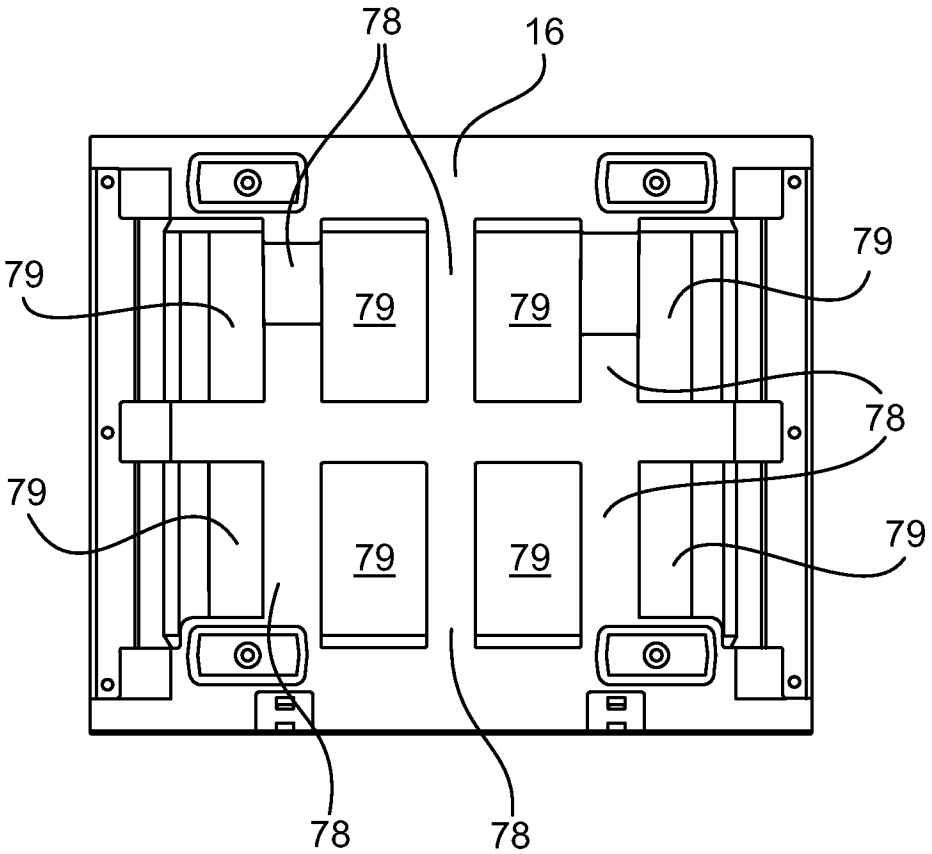
FIG. 4 is an elevational view of the base end wall of the container of FIG. 1.
Figure 7:
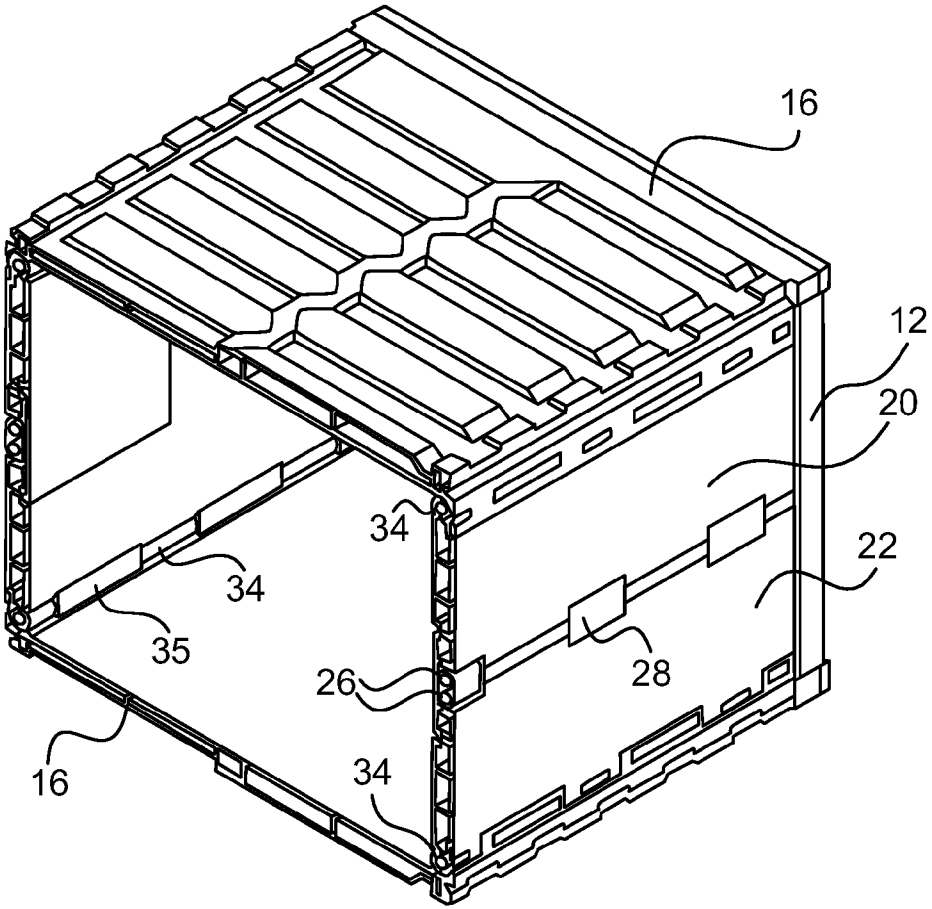
FIG. 7 is a cross sectional view taken along line 7-7 of FIG. 3.
Figure 8:
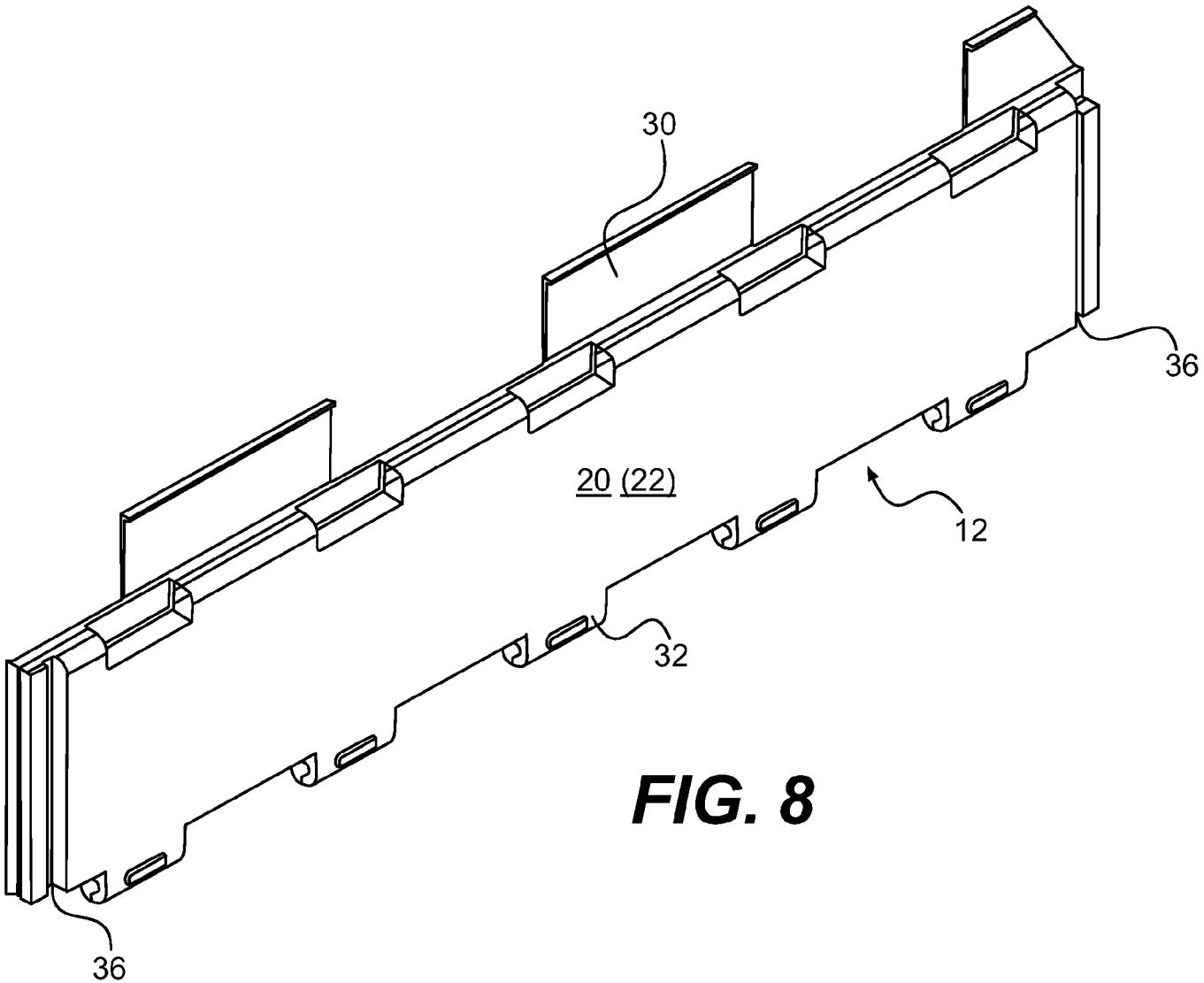
FIG. 8 is a perspective of a foldable side wall.

As shown in FIG. 3, each foldable side wall 12 is comprised of an upper section 20 and a lower section 22 foldably connected together along a double axis hinge line 24 at the midsection of the wall formed by a pair of hinge pins 26 shown in FIG. 7. One of the hinge pins extends through knuckles 32 at the hinge line at the upper section 20 and the other of the hinge pins extends through knuckles 32 at the hinge line at the lower section 22 of foldable side wall 12 as shown in FIG. 8. Separate hinge parts 28 are provided between knuckles of the upper and lower sections through which both of the hinge pins pass. The use of the separate hinge parts 28 in the double axis hinge permits the upper and lower sections of the foldable side wall to fold flat against each other in the collapsed position shown in FIG. 22.

One or both of the upper and lower sections of foldable side wall 12 may be provided with fingers 30 which prevent the side wall from buckling outwardly and overlay, from the inside of the container, the hinge joints to prevent insertion of any sharp objects, such as pins or needles into the inside of the container through the hinge joints. FIG. 8 shows the fingers 30 on the sections 20, 22 of one side wall 12. FIG. 21 shows the container in a partially collapsed position, in which the fingers 30 on both the upper and lower sections 20, 22 are interleaved in a side by side position with each other. The fingers 30 my also have return flanges 31 at the ends of the fingers which fit into slots 33 in the opposing section 20, 22 within each end wall 12 for additional support of the connection between side wall sections 20, 22 in the erected position.

Figure 15:
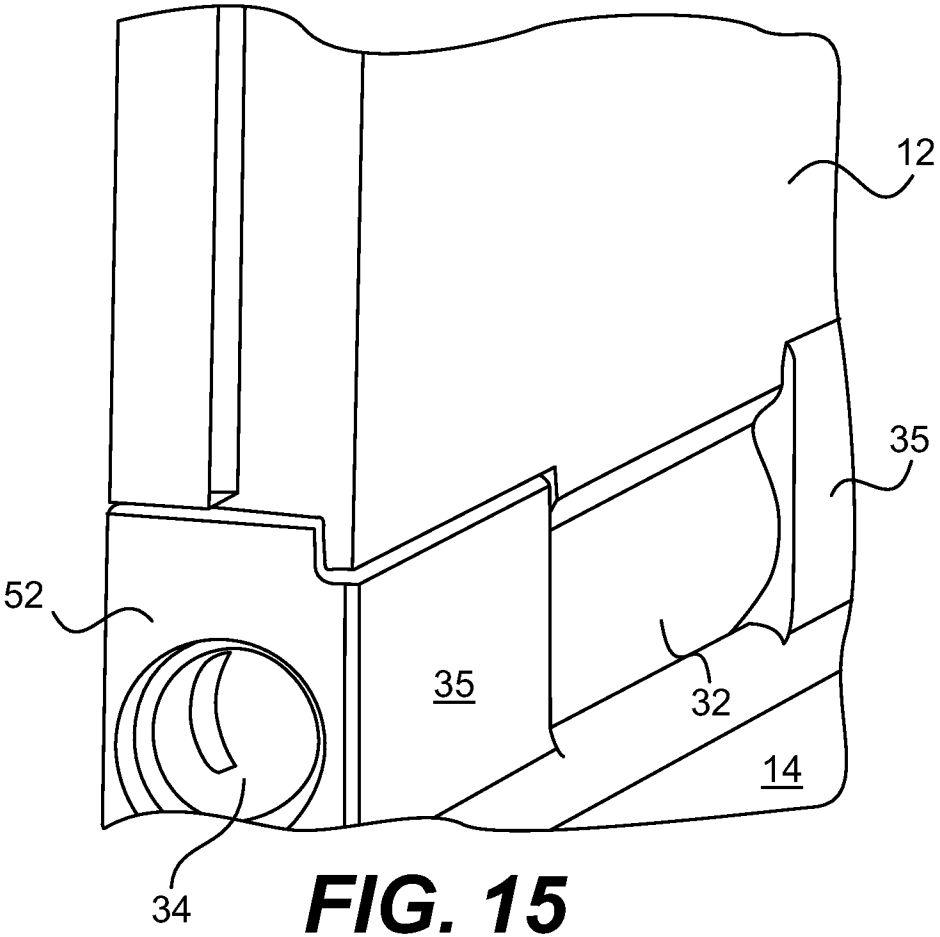
FIG. 15 is an enlarged perspective view of a corner showing a hinged connection between a foldable side wall and a solid side wall.

The outer edges of the upper and lower foldable sections of side wall 12 are provided with knuckles 32 for pivotal attachment to the solid side walls 14, as shown in FIGS. 8 and 21. Hinge pins 34 at the upper and lower edges of each foldable side wall 12 extend through the spaced knuckles 32 of the side wall and through knuckles 35 on the outer edges of each solid side wall 14 to form hinge connections therewith as shown in FIGS. 7 and 15.

The outer ends of each foldable side wall 12 are provided with channels 36 as shown in FIG. 8 which receive flanges from the base and top end walls in the erected position so that the end walls may be slidably fitted onto the ends of the container when in the erected position.

Figure 5:
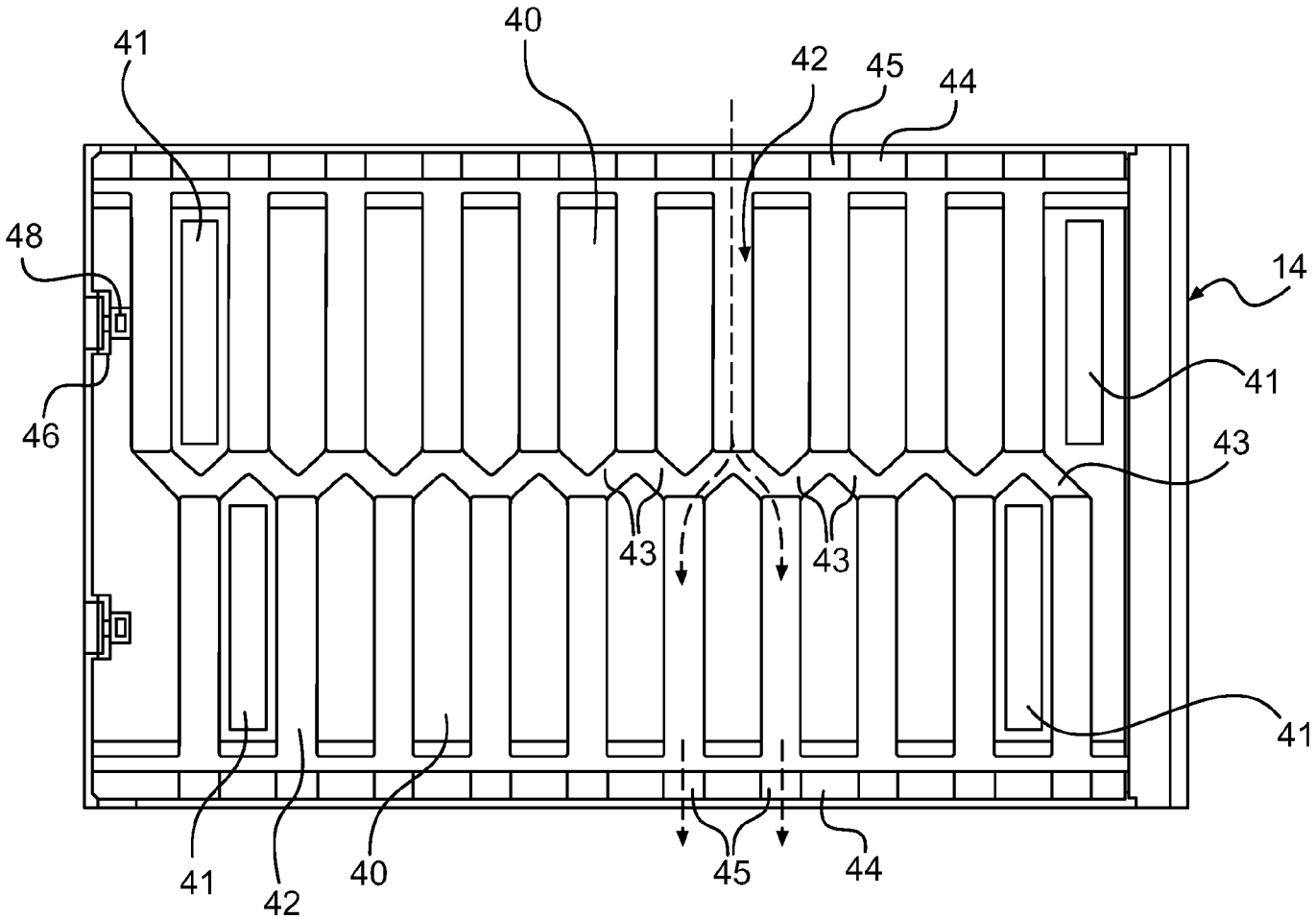
FIG. 5 is a plan view of a solid side wall of the container of FIG. 1.

One embodiment of a solid side wall 14 as shown in FIG. 5 contains upstanding ribs 40 on the outer surface thereof which creates recesses 42 therebetween. Additionally, a zigzag shaped recessed connecting passage 43 interconnects each of the recesses 42 to promote circulation of air along the outer wall surface for freezing and thawing of a product stored in the container. The outer side edges along the length of each solid side wall 14 contain spaced upstanding rectangular blocks 44 with recesses 45 therebetween for continuing the air flow to recesses 42. In another embodiment of solid side wall 14 shown in FIG. 6, the opposing ribs and recesses are not connected by a zigzag channel.

Figure 6:
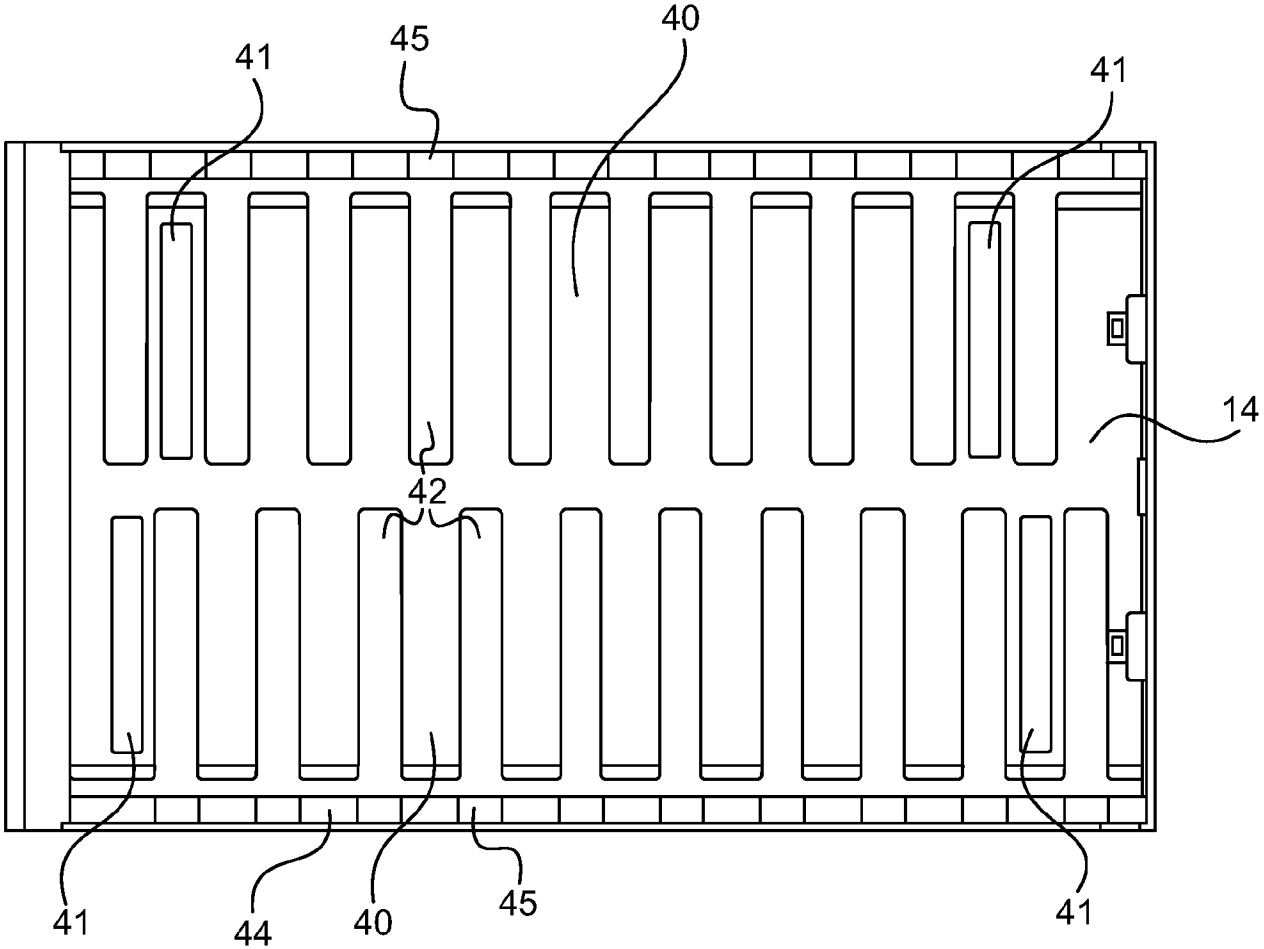
FIG. 6 is a plan view of an alternative embodiment of a solid side wall of the container of FIG. 1.

For promoting the interlock or engagement of two erect containers that are positioned adjacent each other, raised pads 41 are provided on certain ones of ribs 40 toward the ends of solid side wall 14 as shown in FIGS. 5 and 6. Recesses 42 of a side wall 14 of one container receive the raised pads 41 of the side wall 14 of an adjacent container in an interlocking relation. In the collapsed position, in which containers are stacked on each other, the raised pads 41 of one solid side wall 14 prevent the base and top end walls from being received and therefore the base and top end walls 16 and 18 fit onto the opposite side wall 14 which does not have the raised pads 41. Also, the raised pads of the one side wall of one container fit into the recesses of the base and top end walls of an adjacent container for ensuring stacking of collapsed containers when adjacent collapsed containers have the base and top end walls fit on the container, as to be described in greater detail hereinafter with respect to FIG. 22.

FIGS. 5 and 6 also show that one end of each solid side wall 14 contains a pair of notches 46 having a hole 48 therein so that it may be locked with a base or top end wall when the container is closed.

Figure 17:
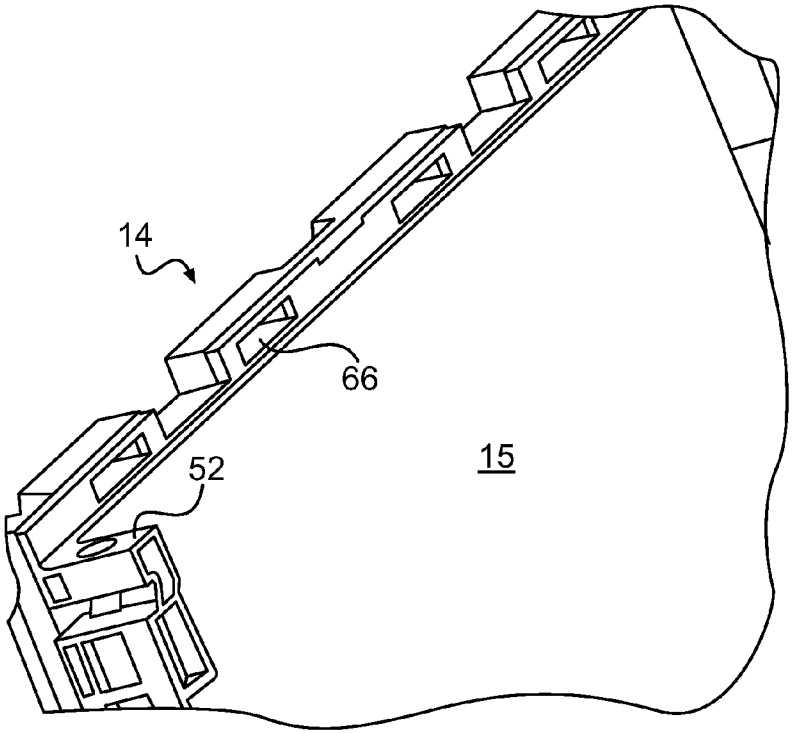
FIG. 17 is a bottom view of the end portion of the solid side wall of FIG. 16.
Figure 16:
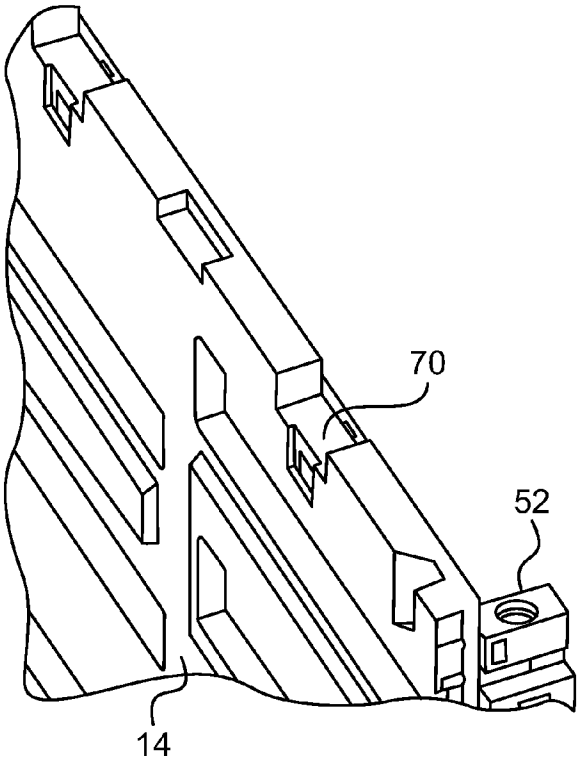
FIG. 16 is an enlarged perspective view of an end portion of a solid side wall.
Figure 19:
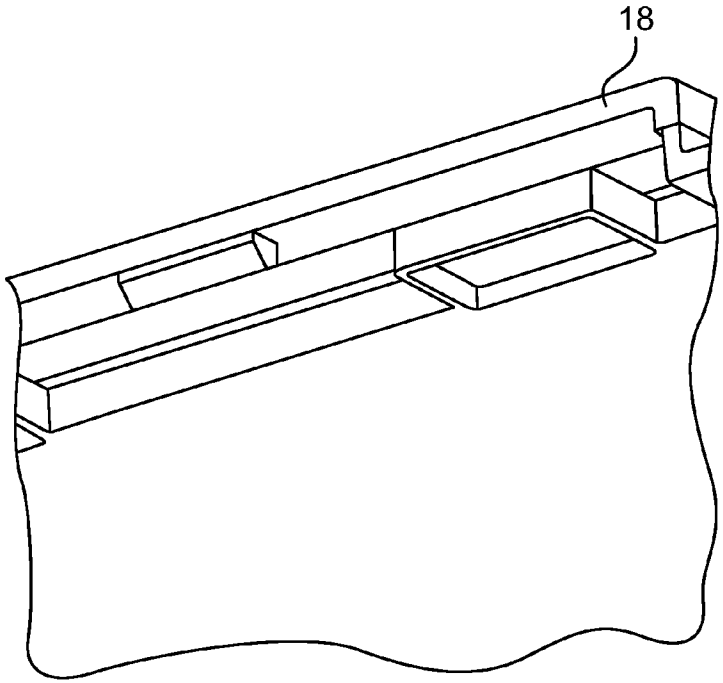
FIG. 19 is an enlarged perspective view of bottom corner portion of the end wall of FIG. 18.
Figure 18:
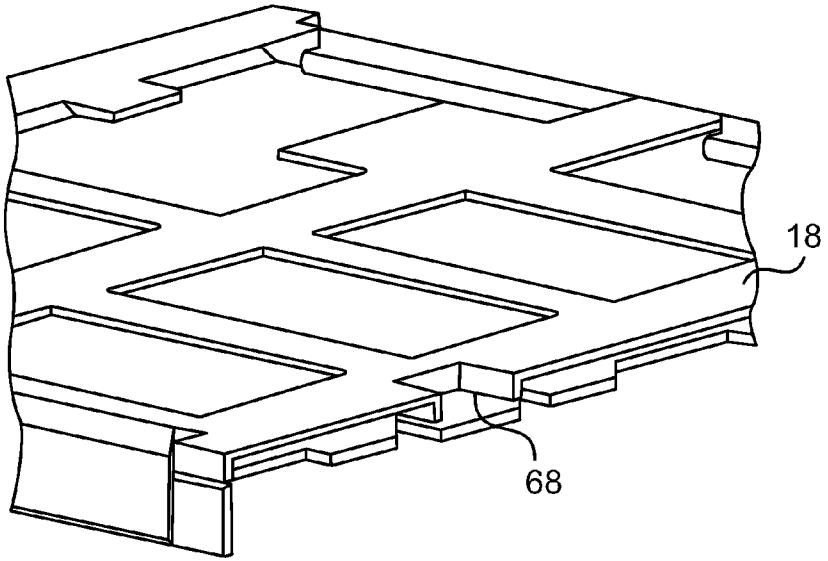
FIG. 18 is an enlarged perspective view of a portion of the end wall of FIG. 12.
Figure 22:
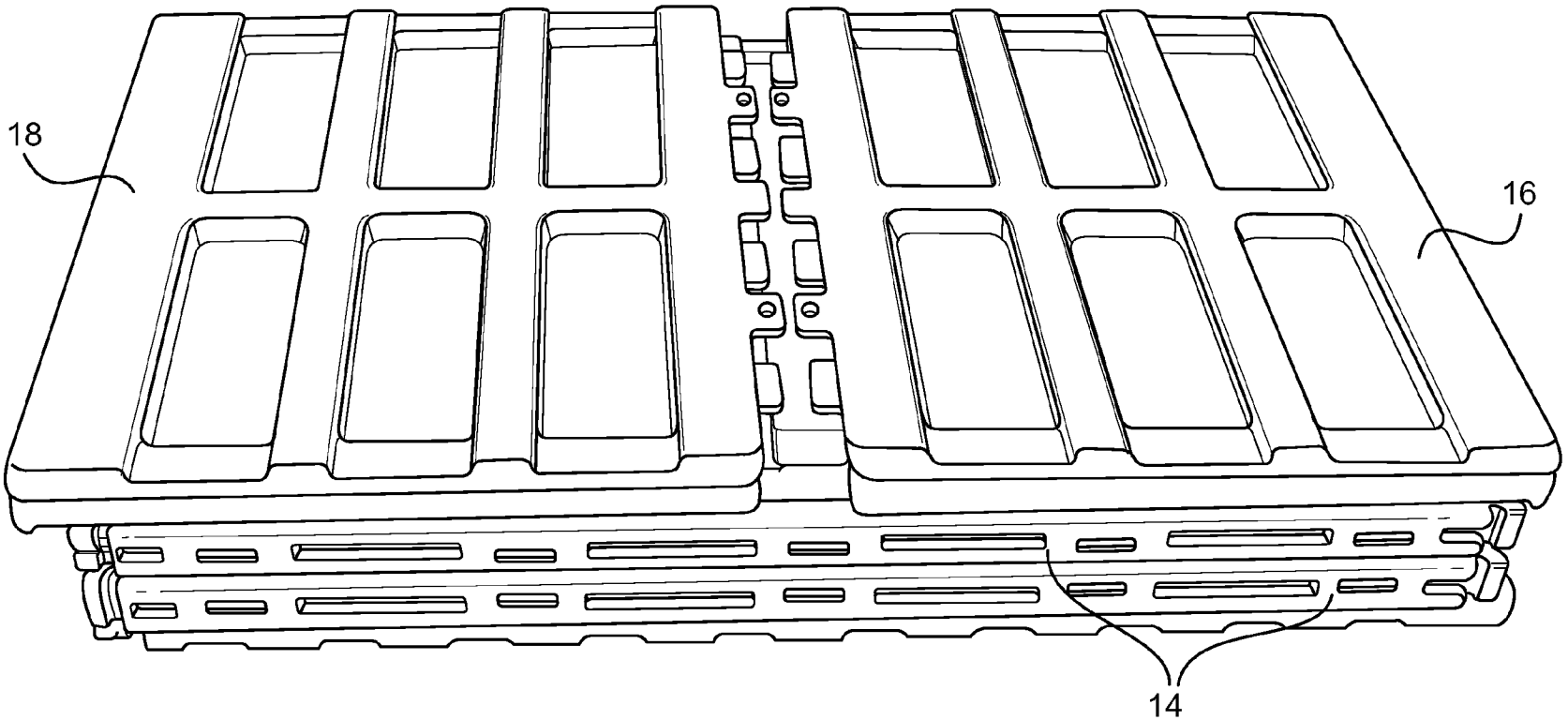
FIG. 22 is a perspective view showing the container in a completely collapsed position with the base end wall and top end wall slidably mounted on opposite ends of a solid side wall.

The interior side 15 of each solid side wall 14 has a smooth face and an inwardly extending flange 52 along the lengthwise edge as shown in FIGS. 16, 17 and 21. Each flange 52 has spaced knuckles 35 which cooperate with knuckles 32 on side walls 12 to receive a pin 34 to form a hinge connection with one edge of the foldable side walls 12 as best shown in FIG. 21. The outside lengthwise edges of each solid side wall 14 each have a longitudinal groove 55 so that the end walls may be slidably inserted therein when the container is in a collapsed position as shown in FIG. 22. Each of the flanges 56 on the top end wall which is positioned above the side wall 12 in the erected position may be suitably reinforced, e.g., with stainless steel or composite material.

Figure 10:
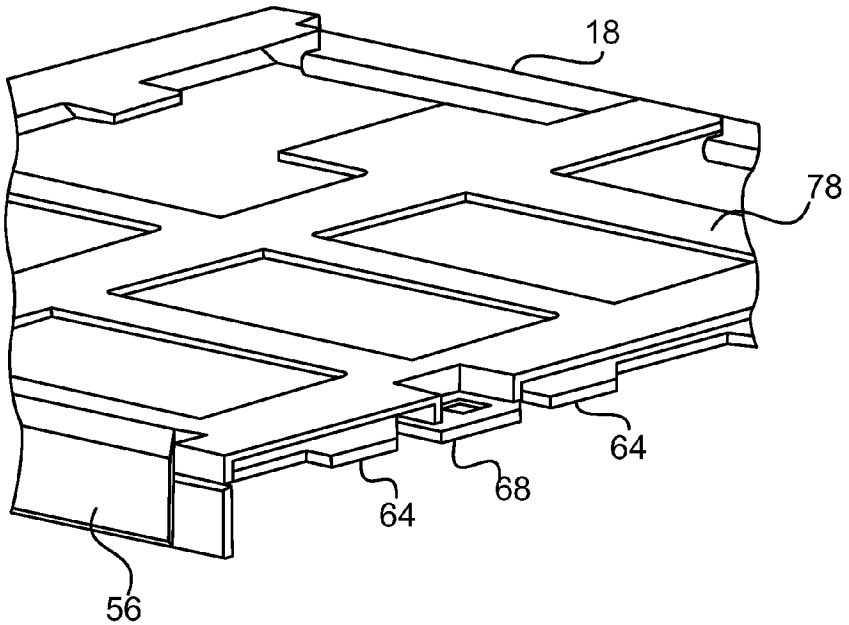
FIG. 10 is an enlarged perspective view of a portion of an end wall.
Figure 14:
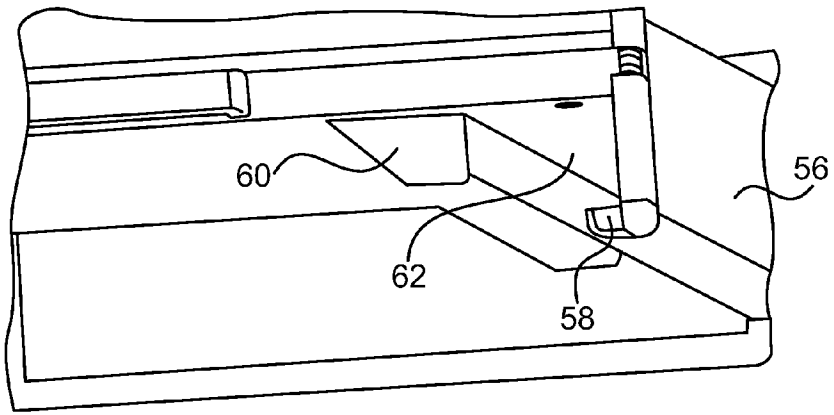
FIG. 14 is an enlarged perspective view of a corner of a bottom of an end wall showing a downwardly extending edge and an inwardly extending locking flange.
Figure 13:
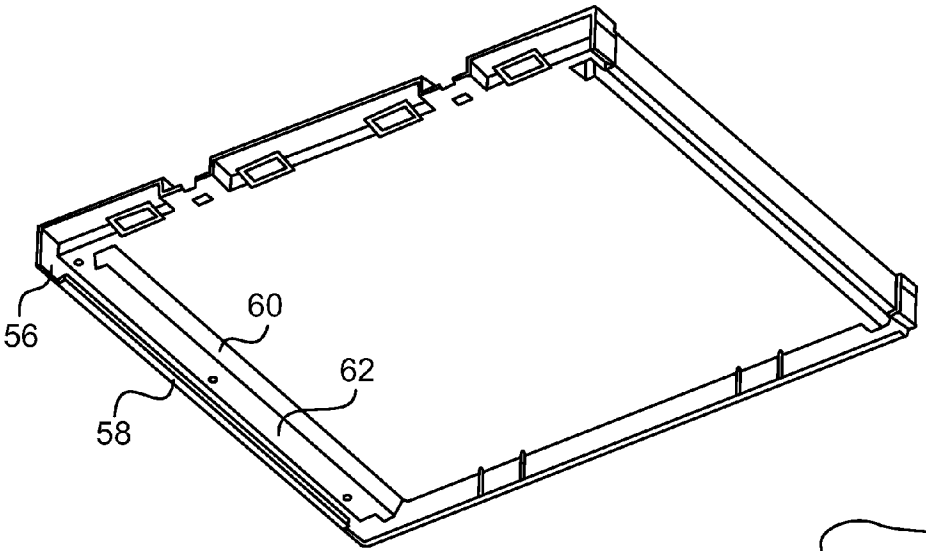
FIG. 13 is a bottom perspective view of the end wall of FIG. 12.

The base end wall 16 and the top end wall 18 are of the same configuration and construction as shown in detail in FIGS. 10-14. Each end wall has a perimeter along three sides which includes an inwardly extending edge of flange 56 having a flange 58 extending at right angles therefrom towards the center of the lid as best shown in FIGS. 13 and 14. An internal rib or shoulder 60 is provided on the inside of the end wall which is spaced from the edge of flange 56 and the flange 58 to form a groove 62 extending lengthwise of the end wall on each side thereof. One end of the end walls 14 is provided with tabs 64 as shown in FIGS. 9 and 10 which interlock with pockets 66 at the end of the solid side wall 14 on both ends of the container due to the 180 degree difference in orientation of the respective side walls 14 as shown in FIG. 17.

Figure 9:
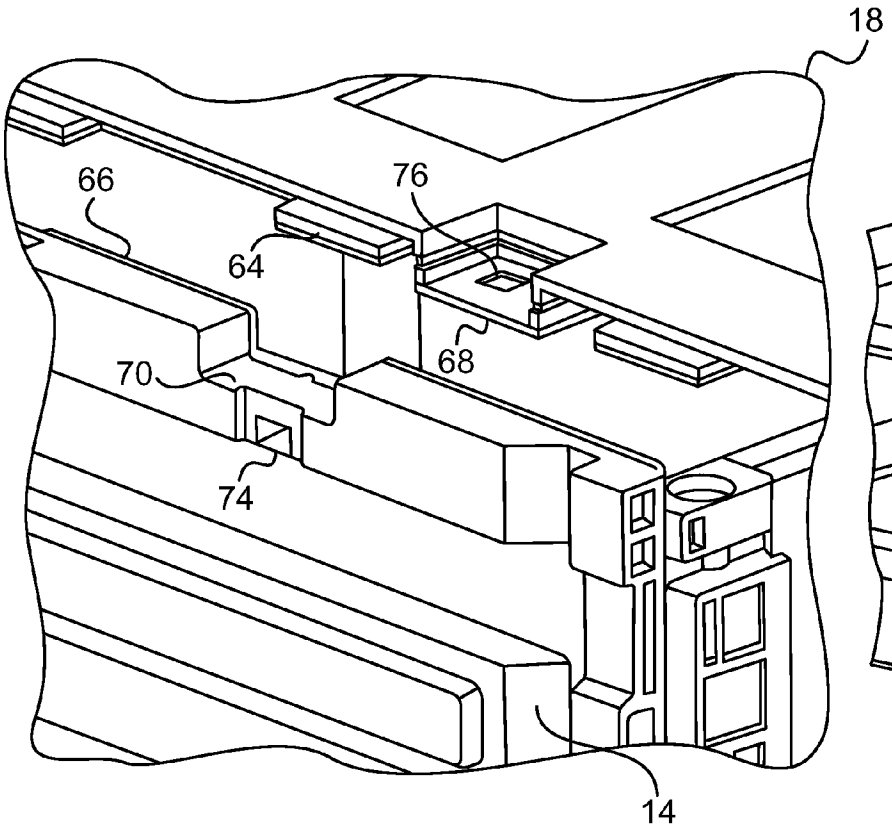
FIG. 9 is an enlarged perspective view of a portion of an end wall and a solid side wall showing interlocking features.
Figure 12:
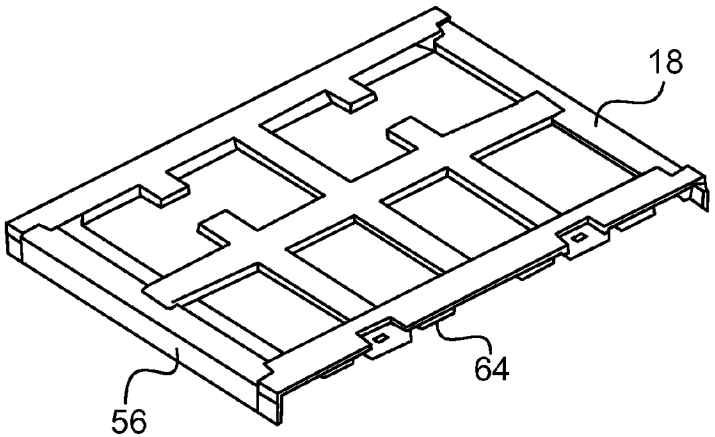
FIG. 12 is a top perspective view of an end wall.
Figure 11:
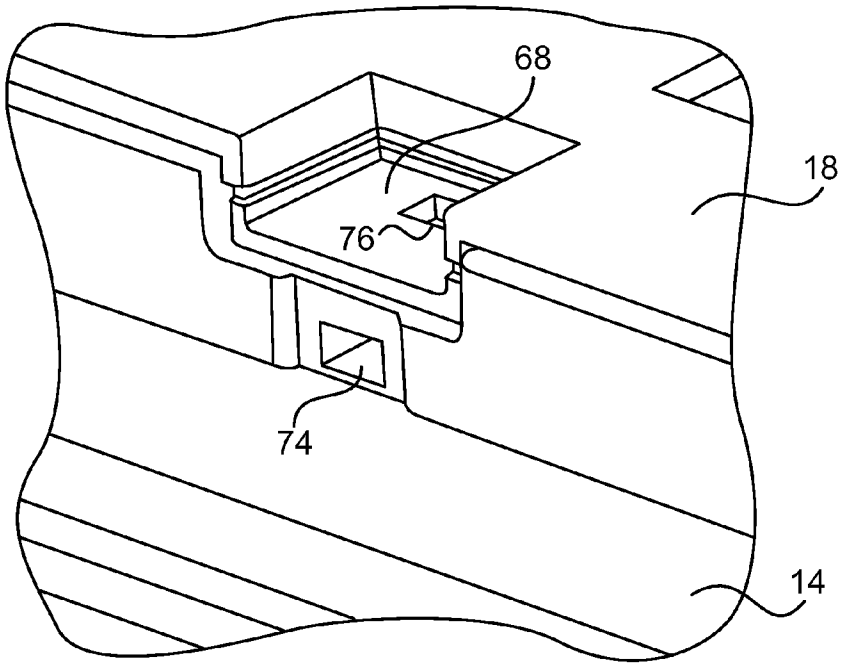
FIG. 11 is an enlarged perspective view of an end portion of an end wall.

Each end wall also has recessed rectangular portions 68 which mate with cutout portions 70 in a solid side wall 14 as shown in FIG. 9. When an end wall is mated with a solid side wall 14 as shown in FIG. 11, the recessed portion 68 fits in the cutout portion 70. The cutout portion 70 may have an opening 74 therein and the recessed portion 68 may have an opening 76 therein so that when the end wall is closed, the container may be locked by inserting a tie (not shown) or other tamper evident device into the mated openings.

Both the base end wall 16 and the top end wall 18 have ribs 78 on the outside face thereof and recesses 79 therebetween. When the container is in a collapsed position with the end walls mounted on one of the solid side walls 14 as shown in FIG. 22 and a plurality of collapsed containers are stacked one on top of another, the raised pads 41 on the one solid side wall 14 engage with recesses 79 on the base and top end walls to stabilize the stack of collapsed containers. A collapsed container can be stacked on an adjacent collapsed container regardless of the orientation of an upper container with respect to a lower container so that a plurality of the collapsed containers can be stacked one on another in a vertical stack.

Figure 20:
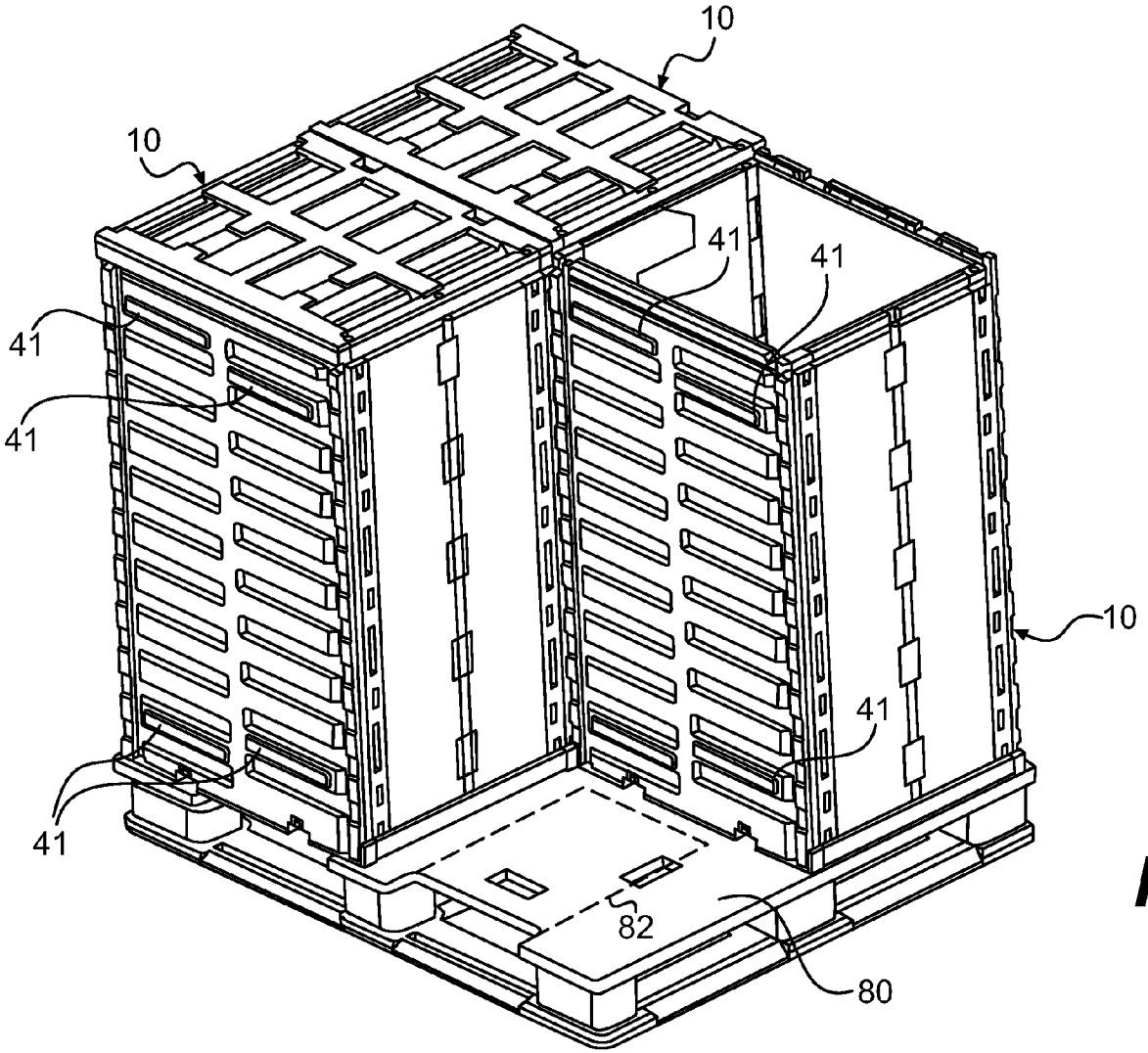
FIG. 20 is a perspective view of three containers stacked side by side on a pallet.

As shown in FIG. 20, a plurality of erected containers may be put on a pallet 80 in contact with each other so that the ribs and recesses of one container mate with the ribs and recesses in the side walls of another container to form a secure stack on the pallet. The pallet may be a pallet such as that disclosed in U.S. Pat. No. 7,543,539. The pallet disclosed in that patent has a cutout portion in each quadrant thereof as shown by the dotted lines 82 in FIG. 20 whereby the tine of a forklift may be inserted under one container on one quarter of the pallet and only that container may be lifted off of the pallet.

The dimensions of each container are such as to preferably fit within the footprint of a pallet or a portion thereof as shown in FIG. 20. In FIG. 20, four such containers may fit within the footprint of a pallet which is, for example, 48 inches by 40 inches when the containers are stacked side by side.

When the container of the present invention is an erected position, the base and top end walls are slidably positioned on the ends of the container. When the container is an erected position, the fingers 30 on the insides of the foldable side walls 12 engage the upper and lower sections of the side wall to reinforce the hinge line along the midsection of the side walls so that the foldable side walls are strengthened against the contents of liquid or other materials pushing outwardly from the interior of the container.

A liner or bag containing a liquid may be placed in the interior of the container which has smooth wall surfaces so that the liner or bag is not punctured during filling of the liquid in the bag and during transportation of the container after the liquid has been secured within the bag. The liquid contents of the container may be frozen after being added to the liner or bag within the container. As a result, the contents of the container take a solid form. The container has a top end wall which is normally closed but which can be completely opened by removing the top end wall so that liquid contents can be removed in a solid, frozen state or removed in a semi-frozen or viscous state through the open end without interference along the edges of the side walls.

When the container is erected and closed, the side walls and end walls form a barrier against entry of any piercing tool that might be used in an attempt to contaminate the contents in the container by piercing the liner or bag therein. For example, a puncture tool may be as small as a pin or a syringe needle which may not only pierce the liner or bag containing a liquid or other contents but also contaminate the contents with a foreign substance in such a manner that would be essentially unnoticeable. The construction of the present container prohibits any direct entry of a piercing tool.

To collapse an erected container, it is only necessary to remove the end walls and press inwardly on the foldable side walls so that the side walls collapse inwardly and the solid side walls rest on the collapsed foldable side walls. The collapsed containers have a nesting ratio of six to one.

Where the container of the present invention is used in connection with contents which are to be frozen, the container has dimensions which permit erected containers to be positioned on a pallet side by side and end to end, with each container occupying one corner of the footprint of the pallet. In this configuration, adjacent containers arranged on the pallet have outer walls surfaces that promote the penetration of air for freezing the contents.

The end walls and side walls of the container may be strengthened by the addition of reinforcement such as metal and/or a composite material inserted therein during molding of the plastic container. Alternatively, the end walls and/or side walls may be formed with two pieces or panels that are hot plate welded together with/without metal reinforcements such as steel that are positioned between the panels. The corrugation created by ribs and the arrangement of channels in the end walls and side walls promote penetration of freezing and thawing of contents therein as well as providing reinforcement for the walls.

Another advantage of the present invention resides in the limited number of parts that are required to construct the container. Both the top end wall and the base end wall are of an identical construction as are the two foldable side walls. The hinge elements are manufactured as an additional part and the hinge pins are also additional elements. In manufacturing the side walls 14, a single mold tool may be used to produce one side wall 14 with raised pads 41 on the outer surface, and one without the raised pads, per container. The raised pads 41 may be formed by mold inserts that are added to the mold tool, which are easily added and removed from the mold tool for the side wall 14 as needed.

Numerous other modifications and adaptations of the present invention will be apparent to those skilled in the art and thus, it is intended by the following claims, to cover all such adaptations with fall within the true spirit and scope of the invention.

What is claimed is:

1. A collapsible rectangular container comprising:

a container body having first and second opposed solid side walls and a pair of opposed foldable side walls hingedly connected to said first and second opposed solid side walls;

a base end wall and a top end wall each being slidably connectable to a separate end of said container body defined by said solid and foldable side walls, when the container body is in an erected position, each of said base and top end walls being individually separable from its respective one of the ends of said container body to permit the container body to be collapsed into a flat configuration by folding said foldable side walls after said base and top end walls have been individually separated from said container body; and each of said base and top end walls being individually slidable onto an outer surface of one of said first and second solid side walls, from opposite ends of said one of said first and second solid side walls, when the container body is in a collapsed position.

2. The rectangular container according to claim 1 wherein the container is constructed of plastic.

3. The rectangular container according to claim 1 wherein said one of said first and second solid side walls is provided with a groove on each outside lengthwise edge to slidably receive said base and top end walls.

4. The rectangular container according to claim 1 wherein said solid and foldable side walls and said base and top end walls each have upstanding ribs with recesses formed between adjacent ones of said ribs whereby said container interlocks with an adjacent container in an erect position when the containers are mated with each other.

5. The rectangular container according to claim 4 wherein predetermined ones of the ribs have raised pads thereon which interlock with recesses on an adjacent container.

6. The rectangular container according to claim 1 wherein said base and top end walls have tabs on one edge thereof which interlock with pockets at the ends of said solid side walls.

7. The rectangular container according to claim 1 wherein each foldable side wall is comprised of an upper section and a lower section foldably connected together along a double axis hinge line.

8. The rectangular container according to claim 7 wherein inner edges of said upper section and said lower section of each foldable side wall are provided with fingers on their interior walls, which are interleaved with each other when the container is in an erected position.

9. The rectangular container according to claim 1 wherein said side and end walls are reinforced with inserts of a hard material.

10. The rectangular container according to claim 1 wherein said end walls are of identical configuration.

11. The rectangular container according to claim 4, wherein predetermined ones of said upstanding ribs on a second of said first and second solid side walls of a collapsed second collapsible rectangular container include raised pads which are received in said recesses in said base and top end walls positioned on said one of said first and second solid side walls of a collapsed first collapsible rectangular container when said second collapsed collapsible rectangular container is stacked on top of said first collapsed collapsible rectangular container.

* * * * *